US007552561B2

(12) United States Patent
Schneckenleitner

(10) Patent No.: US 7,552,561 B2
(45) Date of Patent: Jun. 30, 2009

(54) DRIVE FOR A SLIDING DOOR OR A SWINGING-SLIDING DOOR

(75) Inventor: Alfred Schneckenleitner, Waidhofen/Ybbs (AT)

(73) Assignee: Knorr-Bremse GmbH, Modling (AT)

( * ) Notice: Subject to any disclaimer, the term of this patent is extended or adjusted under 35 U.S.C. 154(b) by 610 days.

(21) Appl. No.: 10/522,122

(22) PCT Filed: Jul. 24, 2003

(86) PCT No.: PCT/EP03/08117

§ 371 (c)(1),
(2), (4) Date: Aug. 15, 2005

(87) PCT Pub. No.: WO2004/011751

PCT Pub. Date: Feb. 5, 2004

(65) Prior Publication Data

US 2006/0096177 A1 May 11, 2006

(30) Foreign Application Priority Data

Jul. 25, 2002 (AT) ..... A 1133/2002

(51) Int. Cl.
*E05F 11/34* (2006.01)

(52) U.S. Cl. ..... 49/362; 49/208; 49/209; 49/210; 49/211; 49/212; 49/219; 49/221; 49/222; 49/223; 105/332; 105/333; 105/334; 105/335; 105/336; 105/337; 105/338; 105/339

(58) Field of Classification Search ..... 49/208, 49/209, 210, 211, 212, 216, 221, 222, 223; 105/332–339
See application file for complete search history.

(56) References Cited

U.S. PATENT DOCUMENTS

| | | | | |
|---|---|---|---|---|
| 2,738,972 | A * | 3/1956 | Willis | 49/208 |
| 3,841,024 | A * | 10/1974 | Cheng | 49/130 |
| 4,329,917 | A * | 5/1982 | Fisher et al. | 454/94 |
| 4,976,066 | A * | 12/1990 | Plummer et al. | 49/225 |
| 5,251,851 | A | 10/1993 | Herrmann et al. | |
| 6,183,039 | B1 * | 2/2001 | Kohut et al. | 296/155 |
| 6,216,393 | B1 * | 4/2001 | Apprich | 49/212 |
| 6,792,717 | B2 * | 9/2004 | Carlsson et al. | 49/218 |
| 6,926,342 | B2 * | 8/2005 | Pommeret et al. | 296/155 |

FOREIGN PATENT DOCUMENTS

| | | |
|---|---|---|
| EP | 0 443 305 | 2/1990 |
| EP | 0 461 104 | 11/1991 |
| EP | 0 478 536 | 4/1992 |
| EP | 0 911 199 | 4/1999 |
| GB | 2 283 054 | 4/1995 |

* cited by examiner

*Primary Examiner*—Katherine W Mitchell
*Assistant Examiner*—Jeff Tang
(74) *Attorney, Agent, or Firm*—Barnes & Thornburg LLP

(57) ABSTRACT

The drive for a sliding door or a swinging-sliding door of a rail vehicle, comprising a guide rail which is fixed inside the rail vehicle and on which a carriage carrying a door leave is arranged in a longitudinally displaceable and optionally rotatable manner, and a spindle drive provided with a spindle which extends parallel to the guide rail and a spindle nut which is connected to the carriage in a fixed manner in the direction of the axis of the spindle. The spindle nut and the carriage are connected by means of a rotative sliding joint.

9 Claims, 3 Drawing Sheets

PRIOR ART

DRIVE FOR A SLIDING DOOR OR A SWINGING-SLIDING DOOR

BACKGROUND AND SUMMARY OF DISCLOSURE

The disclosure relates generally to the drive of a sliding door or swinging-sliding door of a rail vehicle, and more specifically it relates to a drive having a guide rail fixed with respect to the rail vehicle, and on which guide rail a carriage is longitudinally displaceably and optionally rotatably arranged, which carriage carries a door leaf, and having a spindle drive whose spindle extends parallel to the guide rail and whose spindle nut is fixedly connected with the carriage in the direction of the axis of the spindle.

A similar drive is known from the applicant's European Patent Document EP 0 461 104 A. However in this case, instead of providing a spindle drive, a linear drive is provided whose driving device can move only along a straight line extending parallel to the guide rail. The transmission of force from the driving device to the carriage takes place in that the driving device is arranged between two wings of the carriage which extend in a normal manner with respect to the guide rail. The wings are so large that, during the rotating movement of the carriage, the driving device does not leave this area. This solution has been successful in general. However, since linear drives are expensive as well as maintenance-intensive particularly in comparison to spindle drives, a solution is needed with respect to a spindle drive in which the rotating position of the spindle nut is defined by the output. The known solution is not suitable for this purpose.

In a construction which has been known for some time and has been successful, the door leaf hangs on a carriage which itself is displaceable along a circular guide rail fixed to the body. The carriage can also be swiveled about the guide rail, and the door leaf is also linked to the carriage and is swivellable parallel to the axis of the guide rail, whereby the tilt-out movement of the door leaf is ensured. The drive includes a driving spindle rotatable about itself and fixed to the body and a spindle nut running on the spindle. The connection between the spindle nut and the carriage includes a connecting rod which can be swiveled on the spindle nut as well as on the carriage in each case about an axis parallel to the axis of the guide rail.

This construction has essentially been successful and, as mentioned above, has been used for some time but still has certain disadvantages: The connecting rod, by which the moving forces for the door leaf are transmitted in the direction of the axis of the guide rail, is stressed with respect to bending and shear by these considerable forces. These forces have to be transmitted by the two hinge joints, which requires that they be constructed in a correspondingly massive and therefore heavy and expensive manner. As a result of the relatively large distance of the connecting rod or its hinge joints with respect to the axis of the guide rail, on the one side, and with respect to the axis of the spindle, on the other side, the carriage as well as the spindle nut are stressed during the operation on their seats with respect to tilting. In the case of the carriage, this results in an increased edge pressure and, in the case of the spindle nut, results in a one-sided loading of the thread. In addition to all of the above, sufficient space has to be left for the sliding-past of the connecting rod over the entire moving path of the carriage.

Also in the case of pure sliding doors having the initially defined basic construction, it is necessary, for the compensation of tolerances, wear phenomena, different thermal expansions and the like, to use a construction having a connecting rod, which causes the same problems as in the case of swinging-sliding doors.

It is an object of the invention to avoid the above-mentioned disadvantages and provide a construction which requires less space, has a dynamically and statically more favorable flow of force and is also cost-effective in its production. According to the present disclosure, these objects are achieved in that the connection between the spindle nut and the carriage takes place by means of a sliding hinge joint which permits a relative rotating movement as well as a displacing movement in the joint area.

In this manner, it is achieved that the connecting rod can be completely eliminated and that, instead of the two hinge joints, a single hinge joint combined with a displacing seat is provided. The hinge joint is situated essentially in the area of the direct connection between the axes of the guide rail and the spindle. In this manner, the above-mentioned disadvantages of the force transmission by the unfavorable eccentric arrangement are completely avoided, and the displacing seat may be constructed by a claw-type construction of the radial projection on a relative large surface, so that the surface pressure can be minimized.

Furthermore, this construction permits the axial adjusting of the door leaf by inserting or removing shims and thus eliminating the previously necessary adjustment by means of expensive threaded bolts.

These and other aspects of the present disclosure will become apparent from the following detailed description of the disclosure, when considered in conjunction with accompanying drawings.

DETAILED DESCRIPTION OF THE DRAWINGS

Figure 1:
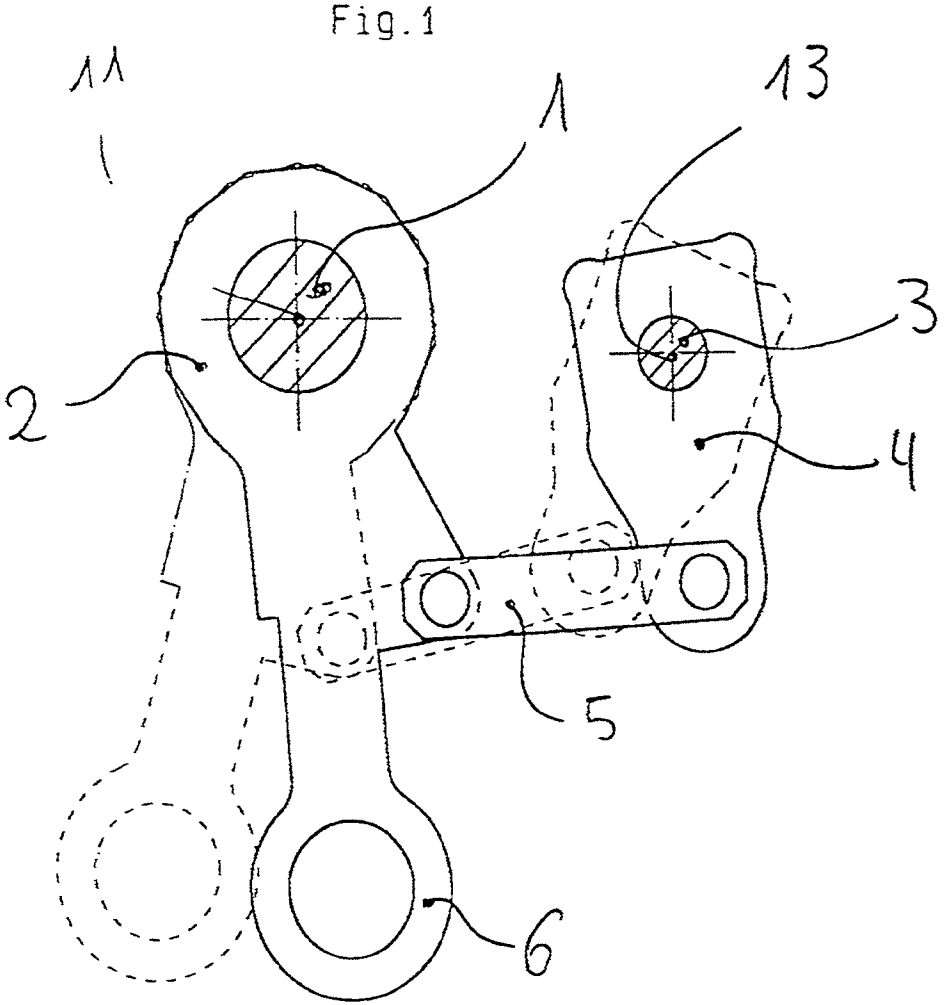
FIG. 1 is a view of a drive coupling according to the prior art.

A door drive according to the prior art in FIG. 1 shows the parts essential to the present disclosure, more specifically, a guide rail 1 fixedly mounted to the body, a carriage 2, a rotatable but otherwise body-fixed spindle 3, a spindle nut 4 and a connecting rod 5 connecting the carriage 2 with the spindle nut 4.

The carriage 2 is arranged to be longitudinally displaceable along the guide rail 1 and, as outlined by the position illustrated by a broken line, in a swivellable manner. At the lower end of the carriage 2, the mounting possibility for a door leaf, which is not shown, is schematically indicated by an eye 6. The longitudinal movement of the carriage 2 along the guide rail 1 is caused by the spindle nut 4 which is moved along the spindle 3 by the rotation of the spindle 3 by a drive which is not shown.

By means of a hinge joint, the connecting rod 5 is in each case connected with a radial projection of the spindle nut 4 and a bearing part of the carriage 2. Thus, when moved along the spindle 3, the connecting rod 5 takes along the carriage 2 and thus the door leaf in the direction of the axis 11 of the guide rail 1.

The tilt-out movement of the door leaf can be caused in different manners. It conventionally takes place by means of a guide rail, which is not shown, is fastened to the body and into which a projection of the door leaf or of the carriage engages, appropriately by means of a roller. As illustrated in FIG. 1, during the tilt-out movement—which corresponds to the transition from the solid lines to the broken lines—, the spindle nut 4 is also swiveled because it is taken along by the connecting rod 5 in the manner of a four-bar mechanism. In the mechanism, the connecting rod 5 is to be considered as a coupling device, and the axis 11 and the axis 13 of the spindle 3 are to be considered as base points.

The drawing illustrates that the longitudinal forces (in the direction of the axes 11, 13) during the displacement of the door leaf are transmitted from the thread of the spindle 3 to the hinge joint between the spindle nut 4 and the connecting rod 5 thus, the spindle nut 4 is caused to tilt with respect to the spindle 3, which results in a non-uniform stressing of the thread. Completely analogously, the carriage 2 is stressed by a tilting moment and thus caused to tilt also with respect to the guide rail 1 by the driving forces transmitted by the hinge joint between the connecting rod 5 and the carriage 2, which causes an increased edge pressure at the edge of the guide of the carriage 2. Finally, by the forces acting upon the connecting rod 5, which occur in a normal manner with respect to the paper plane of FIG. 1, the connecting rod 5 is stressed with respect to bending as well as shear and therefore should have a correspondingly massive construction.

Figure 3:
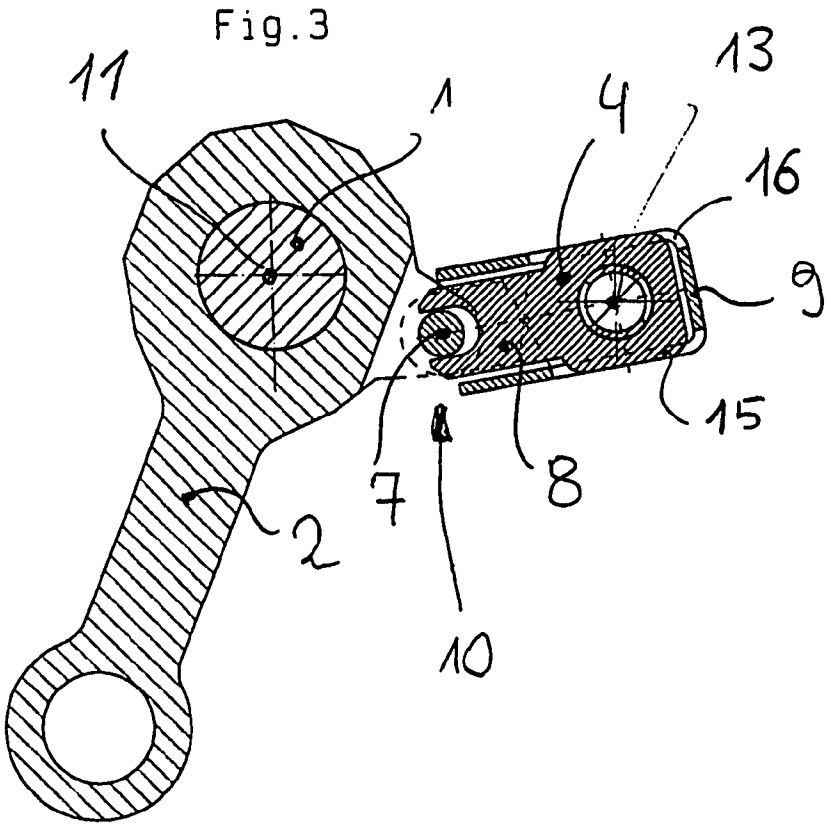
FIG. 3 is a view of the device of FIG. 2 in the swiveled-out position of the door leaf.
Figure 2:
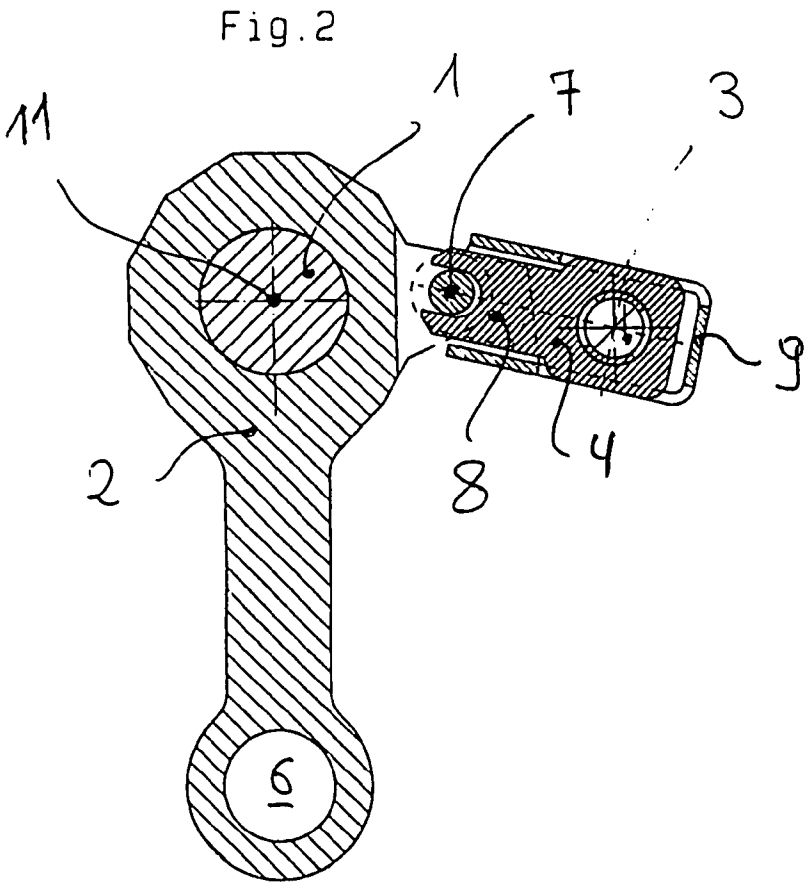
FIG. 2 is a view of a device according to the present disclosure in the swiveled-in positions of the door leaf.

These problems are solved according to the present drive as illustrated in FIGS. 2 and 3: In the specification, the parts which are identical with those of FIG. 1 have the same name and are provided with identical reference numbers. Naturally it is conceivable that these parts may have different constructions or further developments.

An important difference with respect to the solution of the prior art consists of the fact that the spindle nut 4 has a radial projection 8 which, as illustrated, preferably is oriented essentially toward the guide rail, and that this projection 8 interacts with an abutment 7 of the carriage 2. This interaction takes place such that a rotation of the projection 8 about the abutment 7 can take place as well as a displacement, which essentially takes place in the radial direction with respect to the axis 13 of the spindle 3. In the illustrated embodiment, a cover 9 is used for this purpose, which will be explained in detail in the following.

The cohesion of FIGS. 2 and 3 directly indicates the method of operation of the construction according to the invention: When the carriage 2 is swiveled about the guide rail 1, the abutment 7 describes a circular swiveling movement about the axis 11 of the guide rail 1 and, in the process, takes along the projection 8 of the spindle nut 4—in the illustrated example, in the manner of a mangle gear. The change of the distance between the abutment 7 and the spindle axis 13 is compensated in that the projection 8 reaches around the abutment 7 in a claw-like manner and thus allows or compensates not only the change of the angular position but also the change of distance.

Figure 4:
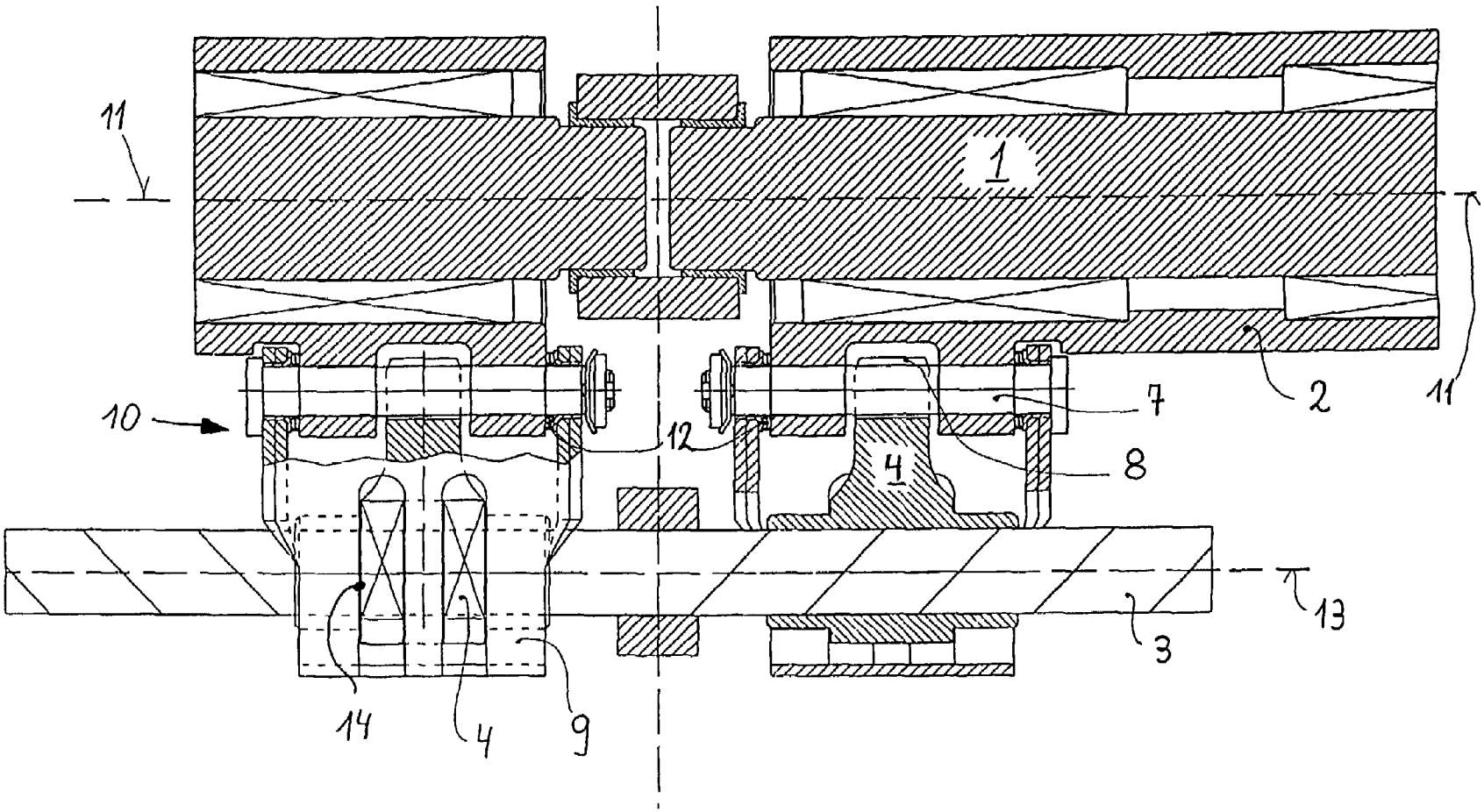
FIG. 4 is a sectional view which extends essentially through the axes of the guide rail and of the spindle.

FIG. 4 is a sectional view of a two-leaf door, which has a different construction using two drives in order to clearly show the design. The sectional view extends essentially through the axis 11 of the guide rail 1 and the axis 13 of the spindle 3 and thus shows the situation and particularly the force transmission in the direction of the two axes 11, 13: The two spindle nuts 4 have a noticeable axial dimension in order to be able to transmit the necessary forces or moments by way of a corresponding number of turns of the spindle thread. At the free ends of their radial projections 8, they have a claw-like or comb-like or pronged construction, as particularly illustrated in FIGS. 2 and 3, where the upper and lower prongs of the claw reach around the bolt-shaped abutment 7 with little play.

As illustrated in FIG. 4, the abutment 7 is constructed in the form of a bolt which is guided through corresponding recesses of a projection of the carriage 2 and is axially and radially fixed in the carriage 2.

The role of the cover 9 is the transmission of the axial forces to the spindle nut 4 as well as to the carriage 2: For this purpose, contact surfaces 14 are provided between the spindle nut 4 and the cover 9. The contact surfaces 14 are displaceable with respect to one another in the direction between the abutment 7 and the axis 13. The projection 8 provides that, despite a certain polydirectional play between the nut 4 and the cover 9, this orientation is maintained. By means of its lateral (in the axial direction) ends 10, the cover 9 is fixedly (or rotatably) connected with the abutment 7 which, in turn, is rotatably (or fixedly) mounted in the carriage 2. In this case, intermediate disks or shims 12 are provided by means of which an adjusting can easily be carried out in the axial direction. The force transmission takes place by way of these shims.

It is naturally not necessary to provide such a massive construction, particularly if, within the scope of a sliding door, the basic idea of the present drive is used only for compensating tolerances and for an easier adjustability. The guide of the cover 9 can be provided directly on corresponding surfaces of the nut 4, without the nut 4 reaching around the abutment 7. It is essential that the nut-cover entity has a rotatable and displaceable construction with respect to the abutment 7.

Also in a heavy-duty application, the above-illustrated massive construction permits the use of plastic for the nut 4, which is desirable for various reasons and ensures an extremely long service life also when operated under harsh conditions.

As also illustrated in FIG. 4, this embodiment permits a simple and cost-effective adjusting between the carriage 2 and therefore the door leaf, on the one hand, and the spindle nut 4, on the other hand, if specifically the axial dimensions between the ends 10 of the cover 9 and the individual sections of the carriage 2 in the area of the abutment 7 are coordinated such that, as a result of the sliding-in of shims 12, the axial position between these two part is determined. Then, by simply exchanging or inserting/removing shims 12, a precise axial adjusting can take place in an area of a few millimeters in a simple rapid and inexpensive manner.

The present drive is not limited to the illustrated embodiment but can be modified in various manners. Thus, it is not necessary that the abutment 7 is essentially arranged in the area of the connection plane between the axes 11 and 13. The abutment 7 could also be arranged in the area in which the hinge joint is situated between the connecting rod 5 and the carriage 1 in FIG. 1. However, it is a disadvantage of each embodiment which provides such an eccentric linkage that high tilting moments are again (as in the prior art) exercised at least on the carriage 2; that the space requirement for the device is enlarged; and that the displacement path in the bearing is enlarged. That, in addition, also greater bending moments occur and the arrangement requires a heavier and more massive construction not only because of the larger dimension but also because of these greater moments, is only marginally mentioned here.

Furthermore, it is not necessary that the prongs of the claws 8 are constructed as illustrated on their front side. It is also conceivable to construct them as an oblong hole, which then makes it absolutely necessary to be able to install or remove the abutment 7 in the axial direction, for example, by means of the bolt 7, as in the present embodiment. On the other hand, it is not necessary to construct this abutment 7 as a bolt. Since the transmission of the swiveling is not connected with very large forces, it is definitely conceivable to provide for this transmission of the rotating movement only a type of driver in the form of a projection or mandrel.

If sufficient space exists in the area of the carriage 2, or very little space is available in the area of the spindle nut 4, it is also conceivable to turn the arrangement around and to mount the abutment 7 on the spindle nut 4. However, this turning-around should be preferred over the illustrated arrangement only in special cases, which is why it is not explained in detail in the specification.

The cover 9 maybe consists of a piece of sheet metal and is bent around the spindle nut 4. In this case, the spindle nut 4 has ribs 15 in planes normal with respect to the axis 13, which ribs 15 protrude into openings 16 of the cover 9 (FIG. 3). Thus, while the play between the nut and the cover is small on all sides, a precise guidance and an unproblematic transmission of forces is achieved.

It is always only essential for the present drive that the connection between the spindle nut 4 and the carriage 2—these components also include all components fixedly connected with them during the intended operation—takes place by a joint which permits a relative rotating movement between these two components as well as a displacing movement between these two components in the joint area. In the specification and the claims, such a joint is called a sliding hinge joint.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A drive for a door of a rail vehicle comprising:

a guide rail fixed with respect to the rail vehicle;

a carriage longitudinally displaceable on the guide rail and carrying a door leaf;

a spindle drive including a spindle which extends parallel to the guide rail and a spindle nut which is fixedly connected with the carriage in the direction of the axis of the spindle;

wherein the spindle nut and the carriage are connected such that the carriage and the spindle nut move relative to each other at a single point of rotation and the connection between the spindle nut and the carriage includes a sliding hinge joint which permits a relative rotating movement between the spindle nut and the carriage as well as a displacing movement only between the spindle nut and the point of rotation.

2. The drive according to claim 1, wherein the spindle nut has radially projecting ends that interact with an abutment of the carriage such that the radially projecting ends rotate about the abutment and simultaneously the abutment is displaced in the radial direction with respect to an axis of the spindle.

3. The drive according to claim 2, wherein the abutment includes a bolt extending parallel to the guide rail.

4. The drive according to claim 1, wherein mutually facing surfaces of components of the sliding hinge joint, which extend perpendicular to the guide rail, have a distance from one another which is closed by shims.

5. The drive according to claim 1, wherein the sliding hinge joint includes the spindle nut and a cover which is slidable with respect to the spindle nut in a plane perpendicular to the axis of the spindle.

6. The drive according to claim 5, wherein ends of the cover have passage holes parallel to the axis of the spindle and a bolt extends through the passage holes.

7. The drive according to claim 5 wherein the cover consists of a piece of sheet metal and is bent around the spindle nut.

8. The drive according to claim 7, wherein the spindle nut has ribs in planes perpendicular to the axis of the spindle, which ribs project into indentations or holes of the cover.

9. The drive according to claim 2, wherein the radially projecting ends of the nut are prongs.

* * * * *